United States Patent [19]

Lerner

[11] Patent Number: 4,457,718

[45] **Date of Patent: * Jul. 3, 1984**

[54] COLOR DISPLAY PRODUCT

[75] Inventor: Stanley Lerner, Highland Park, Ill.

[73] Assignee: Color Communications, Inc., Chicago, Ill.

[ * ] Notice: The portion of the term of this patent subsequent to Apr. 5, 2000 has been disclaimed.

[21] Appl. No.: 450,690

[22] Filed: Dec. 17, 1982

Related U.S. Application Data

[63] Continuation-in-part of Ser. No. 233,843, Feb. 12, 1981, Pat. No. 4,379,696.

[51] Int. Cl.[3] ..... G09F 7/00; A44B 7/00

[52] U.S. Cl. ..... 434/98; 434/367; 40/492; 206/81; 206/472; 428/337; 428/339; 428/43; 428/331

[58] Field of Search ..... 428/328, 337, 339, 480, 428/43, 331; 206/81, 472; 40/492; 434/84, 98, 99, 100

[56] References Cited

U.S. PATENT DOCUMENTS

| | | | |
|---|---|---|---|
| 3,043,710 | 7/1962 | Patten et al. | 428/480 |
| 3,158,495 | 5/1964 | Murray et al. . | |
| 3,224,113 | 12/1965 | Goldsholl | 434/98 |
| 3,234,038 | 2/1966 | Stephens et al. | 428/328 |
| 3,312,563 | 4/1967 | Rusch | 428/480 |
| 3,322,605 | 5/1967 | Frech . | |
| 3,335,029 | 8/1967 | Holben . | |
| 3,434,227 | 3/1969 | Brown, Jr. | 434/98 |
| 3,511,213 | 5/1970 | Reed . | |
| 3,753,769 | 8/1973 | Steiner | 428/331 |
| 3,967,009 | 6/1976 | Blake . | |
| 4,058,645 | 11/1977 | Steiner | 428/331 |
| 4,061,521 | 12/1977 | Lerner et al. | 156/265 |
| 4,104,809 | 8/1978 | Day et al. | 434/104 |
| 4,146,031 | 3/1979 | Fujiyama et al. | 428/328 |
| 4,379,696 | 4/1983 | Lerner | 428/339 |

FOREIGN PATENT DOCUMENTS

| | | |
|---|---|---|
| 1232971 | 5/1971 | United Kingdom . |
| 1509791 | 5/1978 | United Kingdom . |

OTHER PUBLICATIONS

Hercules Technical Literature Report No. CSL-82A.

*Primary Examiner*—William R. Dixon, Jr.
*Attorney, Agent, or Firm*—Fitch, Even, Tabin & Flannery

[57] ABSTRACT

A color display product for the display of various finishes of paint coatings. The product includes a film base which comprises polyethylene terephthalate, or acrylic coated polypropylene.

40 Claims, 10 Drawing Figures

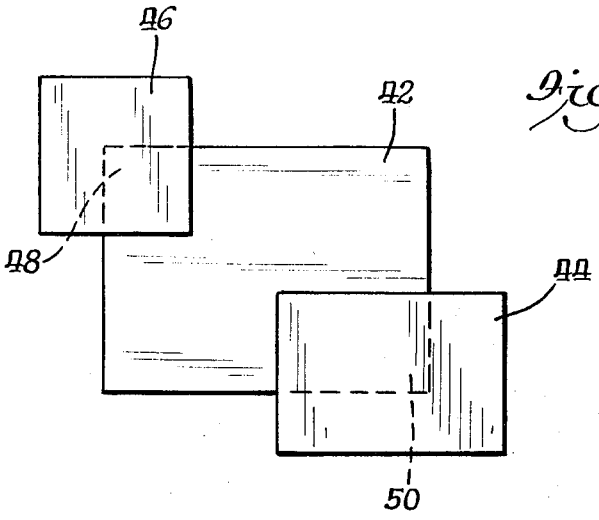
Fig. 8.
Fig. 9a.
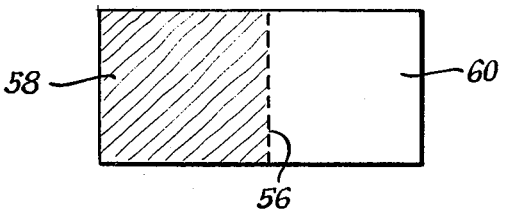
Fig. 9b.
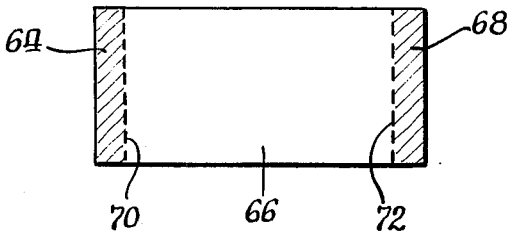

COLOR DISPLAY PRODUCT

This is a continuation-in-part of Ser. No. 233,843 filed Feb. 12, 1981, now issued as U.S. Pat. No. 4,379,696 on Apr. 12, 1983.

The present invention relates to color sample display products for paints including paints having an aqueous phase and where such products include color sample paint chips or swatches. Such chips or swatches are generally affixed to and are displayed on paper cards, mounts or the like wherein each chip or swatch is coated with a different color or tone thereof so that a consumer may order a particular paint or color after making a visual selection from the array of colored chips on the card.

Paints are usually marketed or displayed to the consumer through colored chip or colored swatch bearing sheets. These sheets often are paper having color chips adhesively affixed thereon. These color chips heretofore have been paper coated with paint, the chips being adhesively attached in display fashion to the bearing sheet with indicia identifying the color of each chip. The swatch bearing sheets are manufactured by methods and apparatuses as generally described in U.S. Pat. No. 4,061,521 to Stanley Lerner et al., which heretofore used paper for the automated mass production of colored chip or swatch being sheets.

The development of emulsion paints has been rapid and remarkable. Emulsion paints generally consist of two liquid phases one of which is water and one phase which is in small droplets dispersed in a continuous phase. In latex paints, however, the dispersed phase is a plastic semisolid forming an emulsion in water. These paints are easy to apply and are less expensive than oil base paints. They may be thinned with water, and brushes or coaters may be cleaned with soap and water. Generally, there is no unpleasant odor and there is little or no risk of fire or explosion as a result of use of volatile solvents.

The fact that the continuous phase of emulsion and latex paints in water lends to their advantages. It, however, creates a problem with respect to their marketing and display, and creates a limitation with respect to the surfaces to which they can be applied. Applying paint containing substantial amounts of water to paper chips or swatches has not been successful because the water causes the paper to rumple or buckle. This phenomenon is the antithesis of the purpose of the display and marketing of paints in an attractive fashion.

It is known that when using paint that is a latex or emulsion with water as the continuous phase, the paper to be painted has to be sized to seal the pores in the paper against the water in the paint. This in not only time consuming and increases the cost of the display product, but does not entirely prevent the paper from absorbing water.

Organo sheet polymers generally do not absorb water and would provide a thin medium for color chips or swatches to be coated with less expensive latex water base paint, but previously have not been used for the mass production of swatch bearing sheets by the methods and apparatuses generally described in the U.S. Pat. No. 4,061,521. This is because such sheets have not exhibited the proper physical characteristics for use in connection with such method and apparatuses. Polyethylene distorts when used in conjunction with automated equipment. Cellophane or transparent cellulose sheeting is not suitable for making painted swatch bearing sheets because it does not have sufficient tensile strength to permit its use with automated equipment and would tear in the manufacturing process. Cellulose acetate provides a generally clear film, but curls when it is painted and does not provide an attractive color display product. Polypropylene by itself is not usable for making swatch bearing sheets because paint will not adhere to polypropylene.

Another problem exists in displaying paint attractively such that various finishes of a paint are properly displayed for aesthetic or communicative purposes. Further in respect to the display of paint having a finish with a high gloss, such paint has a tendency to block or fuse to an overlying surface even after such paint has dried. In color display products, such as painted swatch bearing sheets or cards, overlying sheets would or can remove paint from the painted swatches on the card or sheet lying thereunder rendering the sheets unattractive.

Still another problem exists in displaying various tones of a paint, or the display of a plurality of paint colors, especially in selecting a second color or colors which can be attractively used with a particular paint color. Ideally a color chip with overlapping chips of varying colors may be used to show various tones of a paint or a plurality of colors which can be used with a particular color. Heretofore, however, color chips have been made with sized paper which is relatively thick. This made a plurality of overlapping chips unduely thick, asethically unattractive and not useful for the display and marketing of paints.

Yet another problem exists in the display of paint colors wherein a color display card often displays a plurality of colors with a plurality of color chips on a mount base or display card. Often the viewer desires to view the color remote from the card without the distraction of the display product and/or other colors on the card. Heretofore, paint chips have not been removable from the mount base because an adhesive which permitted removal would create the hazard of the adhesive bond between the chip and mount base weakening and unintentional loss of the color chip. Further an adhesive which permitted the removal of the chip dictated the entire removal of the chip from the mount base. This meant removal of the entire color from the display card and loss of the chip and its corresponding color from the card for future reference. Gluing only a portion of the chip to the mount base, yet having the chip capable of being removed from the card could be achieved by having a tear line such as by perforating the chip such that the chip could be torn away along the perforation from the portion glued onto the mount base. Heretofore, however, painted sized paper did not tear along a perforated line to readily and consistently yield an attractive colored chip. Often sized paper will tear into the chip and the color displayed. This yields unattractive color chips which is just the opposite of the purpose of an attractive paint display card and the successful marketing of paints.

The finish of any given color of a paint may vary so as to substantially affect color selection. Heretofore, separate chips would have to be made and separately applied to display different finishes of a particular paint and color. This increases the time and cost required to manufacture a display product illustrating the various finishes a paint may have.

A need exists, therefore, for a material which will not rumple or crumple when painted with paints containing water such as emulsion or latex paints. A need exists for a medium for the display of paints with glossy finishes such that the paints will not fuse or stick to overlying surfaces. A need exists for a medium which permits the display of more than one paint finish and a method for the manufacture of such a medium. Further, a need exists for a color display product and a method for manufacturing same wherein the product includes colored chips which may be easily and readily removed from a mount base, yet have some part of the chip remain on the base for future reference. Still further, a need exists for a medium which permits the overlapping of colored chips or swatches for the display of various multiple tones, finishes or colors.

In accordance with the present invention, it has been found that a polypropylene film coated with an acrylic polymer may be coated with an emulsion or latex paint wherein the continuous phase is water without the rumpling or buckling of the painted surface. Further such film permits the display of paints with a glossy finish when the paint is applied to the film and the paint coating is viewed through the medium of the film. The surface of the film prevents the paint coating from fusing or sticking to an overlying surface. According to other aspects of the present invention, acrylic surface coated polypropylene and polyethylene terephthalate films provide a medium for a color swatch or chip which is a part of a color display product which permits (1) a single chip to display more than one finish of a paint coating, (2) the overlapping of a plurality of chips for the display of various colors and tones of paints, and (3) a tear line in a color chip for easy removal thereof from a mount base for the display of the chip remote from the color display product.

Accordingly, an object of the present invention is to provide a medium for the display of paint coatings.

Another object of the invention is to provide chips or swatches which are a part of a product for the display of paint coatings, and a method of providing such color display product wherein a chip or swatch displays more than one tone or finish of the paint coating.

Another object of the invention is to provide colored chips or swatches which are a part of a product for the display of paint coatings and a method for providing such color display product wherein the chips or swatches overlap, as in stacked relation, for the display in adjacent relation of more than one color, tone or finish of the paint coating.

Still another object of the invention is to provide colored chips or swatches which are a part of a product for the display of paint coatings and a method for providing such color display product wherein such chips or swatches are easily and readily removable from a mount base of the product for display of the paint coating on such colored chips remote from the color display product.

Yet another object of the present invention is to provide a base for latex or emulsion paints with a water phase wherein such base will not rumple or crumple when painted and exposed to the water in the paint.

Yet still another object of the invention is to provide a base for any paint which will provide a medium to view the paint coating through the medium and provide a means for the display of more than one finish of the paint coating.

Other objects and advantages of the invention will become apparent from the following detailed description taken in connection with the accompanying drawings in which:

FIG. 8 is an alternate embodiment of the invention wherein the chips or swatches overlap to show a plurality of colors of finishes or colors of the paint coating; and FIGS. *9a* and *9b* are alternate embodiments of a tear off chip having tear lines.

Figure 1:
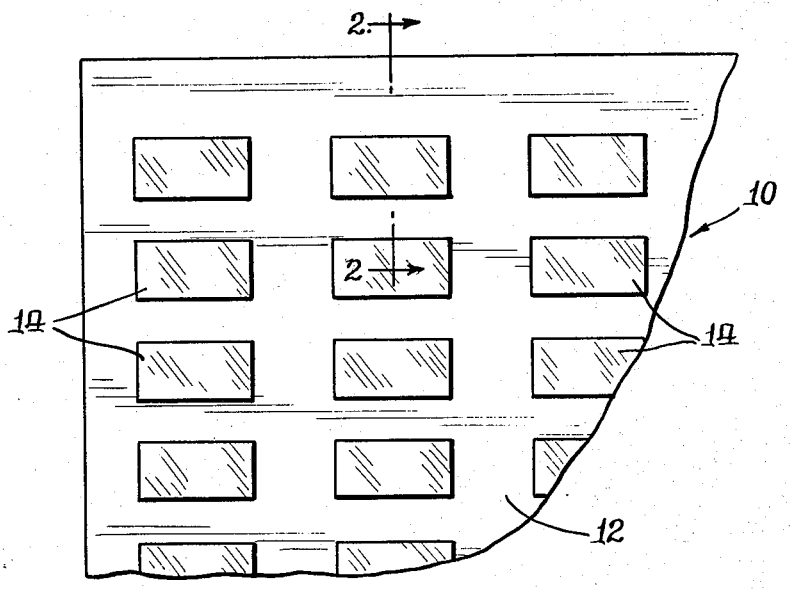
FIG. 1 is a plan view of a color display sheet in accordance with the present invention, the display chips being shown adhesively fixed on the sheet in rows.

Referring now to FIG. 1 of the drawings, a display card 10 is comprised of a base mount 12 which is a paper card or the like with a plurality of color chips 14 affixed thereon by means of an adhesive or the like. Although the mount card is shown with a plurality of chips thereon, the mount card may be used to display only one color chip or color per mount card as in U.S. Pat. No. 4,104,809 to Day et al. The mount card may be made of any suitable material to which organo polymeric film may be affixed, the mount card most commonly being thick paper or cardboard.

Figure 2:
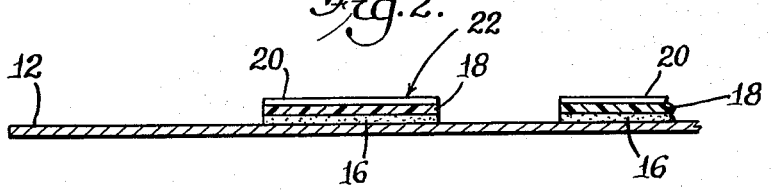
FIG. 2 is a side elevational view of the display sheet along line 2—2 of FIG. 1.

According to the invention, the color chips 14 have a polymeric base 18 of acrylic coated polypropylene or polyethylene terephthalate, polyethylene terephthalate also being known as Mylar which is a registered trademark of the E. I. DuPont DeNemours & Co. The acrylic coated polypropylene and polyethylene terephthalate resin provide a transparent film base which has a thickness range from about 0.00025 inches to about 0.0075 inches. In the invention, the preferred range for the thickness of the film is from about 2 mil to about 7 mils. Referring to FIG. 2, according to one aspect of the invention the polymeric base 18 is coated with paint such as a latex or emulsion paint 20 which is on the side of the film base which faces away from the mount base. The coating of the polymeric base may be by the use of a knife over roll coating operation in a web as known in the art. After coating the polymeric base with paint, the coated polymeric base is cut into strips and the strips cut into swatches which are affixed to the paper mount card by means of adhesive 16. U.S. Pat. No. 4,061,521 to Lerner et al., assigned to Color Communications, Inc., discloses a method and apparatus for the manufacture of swatch bearing sheets, such patent being incorporated by reference as if fully rewritten herein. It is preferable to use the latter method and apparatus when using polymeric base with a thickness of about 3 mils or less.

Figure 3:
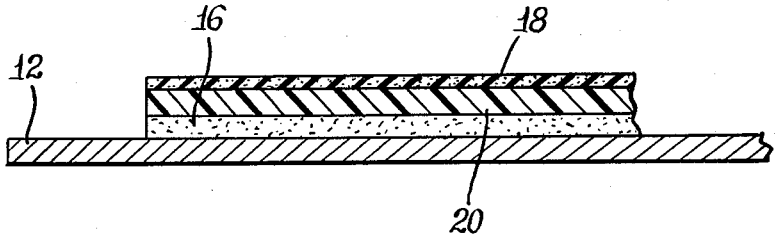
FIG. 3 is an expanded side view of the display chip of the invention wherein an a polypropylene sheet coated with an acrylic polymer is coated with a paint coating.

For direct display of a paint coating and its actual finish, the painted surface 22 of the polymeric base is on the side of the film base which faces away from the mount base and is opposite the side of the polymeric base which is adhesively fixed to the paper card. The translucency of the film may be utilized and the paint may be displayed with a high gloss finish when the chip is affixed to the mount card with the unpainted polymeric base facing away from the card as shown in FIG. 3. The gloss of the surface of the film 18 displays the paint 20 as if it had a glossy finish. The film thereby permits the display of a paint coating with a glossy finish without the problem of having the glossy surface fuse to an overlying surface.

Figure 4:
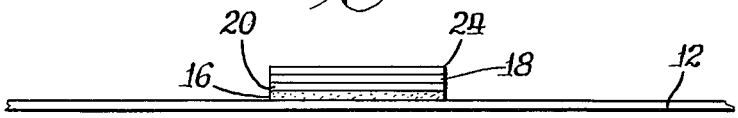
FIG. 4 is a side elevational view of the chip or swatch, along line 4—4 of FIG. 7, used to display more than one finish of the paint coating from the same chip when the coating is viewed through the organo polymeric medium of the paint chip.

A plurality of finish or gloss variations of the paint coating also may be displayed on a single chip by utilizing the translucent properties of the polymeric film. As seen in FIG. 4, one side of the polymeric base 18 (hereinafter referred to the "top side") is coated with a clear lacquer solution forming a lacquer film 24. Lacquers which maybe used in the invention include nitrocellulose lacquers and acrylic lacquers.

The lacquer may be coated on the film by a knife roll coating operation. Preferably, however, it is applied to the polymeric base by a Gravure printing process (a flexographic process may be used but it not preferred) wherein etched cylinders are used to apply the lacquer solutions which vary in clarity. By using the printing process a thinner coat of lacquer may be applied to the polymeric film base. This results in a cost and materials saving. As shown in FIG. 4, the paint coating 20 to be displayed is applied to the polymeric base 18 on the side of the film which will be facing a mount base or the opposite side of the translucent film from which the paint coating will be viewed through the polymeric film (hereinafter the "bottom side" of the polymeric base). The side of the polymeric base with the paint coating, or bottom side, generally will have an adhesive 16 applied thereto to affix the lacquer and paint coated polymeric base to the mount base 12. Although other means, such as tonque and slot for affixing color chips to mount bases, may be used as are known. The clarity of the lacquer print or coating is used to control the appearance of the gloss of the paint coating when viewed through the lacquer and polymeric base. The composition of the lacquer controls its clarity and the clarity of the lacquer film printed or coated onto the polymeric base, completely clear lacquer providing a glossy finish. Lacquer such as nitrocellulose lacquer may be purchased in forms which will yield varying finishes including gloss, semi-gloss and flat finishes. Alternatively, magnesium silicate and silica may be added to clear lacquer to provide a flatter appearance to control gloss.

Figure 5:
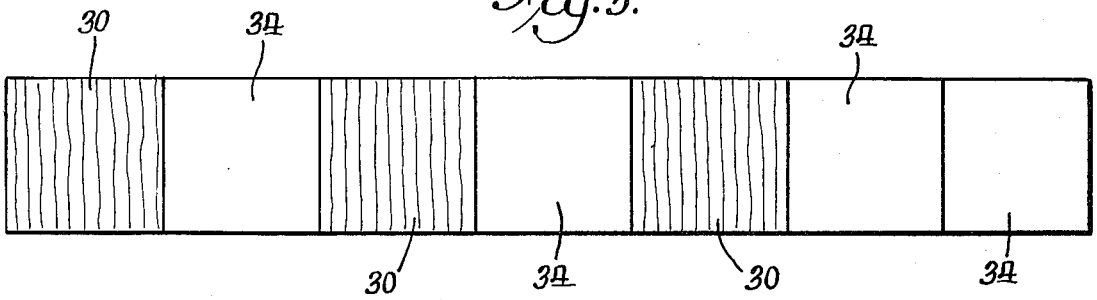
FIG. 5 is an expanded plan view of part of a color display sheet prior to cutting into small chips or swatches and partially processed to show only one finish of a paint coating.
Figure 6:
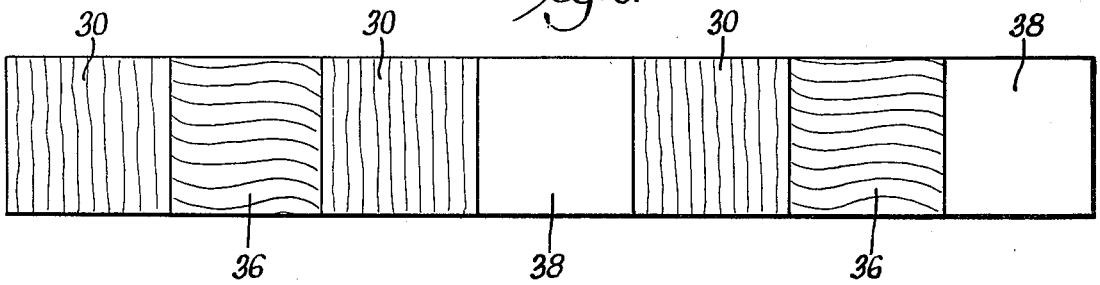
FIG. 6 is an expanded plan view of part of a color display sheet prior to cutting into small chips or swatches and partially processed to show three finishes of a paint coating.

As shown in FIGS. 5 and 6 to obtain a color swatch which displays a paint coating in a flat, semi-gloss and glossy finish, a portion of the film base is printed with lacquer to illustrate one finish, then printed again and yet again to illustrate a second and third finish, respectively.

As shown in FIG. 5, to achieve a flat finish to the polymeric film, lacquer is printed onto the film base as at 30 with cylinders etched in a cross hatched screen design. When using silica to control gloss, the lacquer which provides a flat finish has about ¼ pound of silica powder/gallon of lacquer, the silica having a particle size of from about 1 to about 7 microns. Adjacent areas 34 are not printed with lacquer with the cylinders printing for a flat finish, but are left uncoated for a subsequent printing of a different lacquer for a different finish.

As shown in FIG. 6, areas 36 of the film base, which are immediately adjacent to the areas 30 printed for a flat finish, are printed with second lacquer for a semi-gloss finish with cylinders etched in a cross hatched screen design. When using silica to control gloss, the lacquer for a semi-gloss finish has about ⅛ pound of silica powder/gallon of lacquer, the silica having a particle size of from about 1 to about 7 microns. The silica in the lacquer may deviate from that described with the amount of silica controlling the finish for paint coatings that range from flat to glossy when the paint coatings are applied to a polymeric film base according to the invention.

To achieve a gloss finish, lacquer may or may not need to be applied to the top surface of the polymeric base. The translucent smooth surface of the polymeric film base of the color chip supplies a gloss finish for the glossy display of the paint coating on the bottom of the polymeric base. As shown in FIG. 6, areas 38, which are immediately adjacent to areas 36 printed for a semi-glossy finish, may be coated with clear lacquer, although as stated this coating is optional to achieve a glossy finish.

Figure 7:
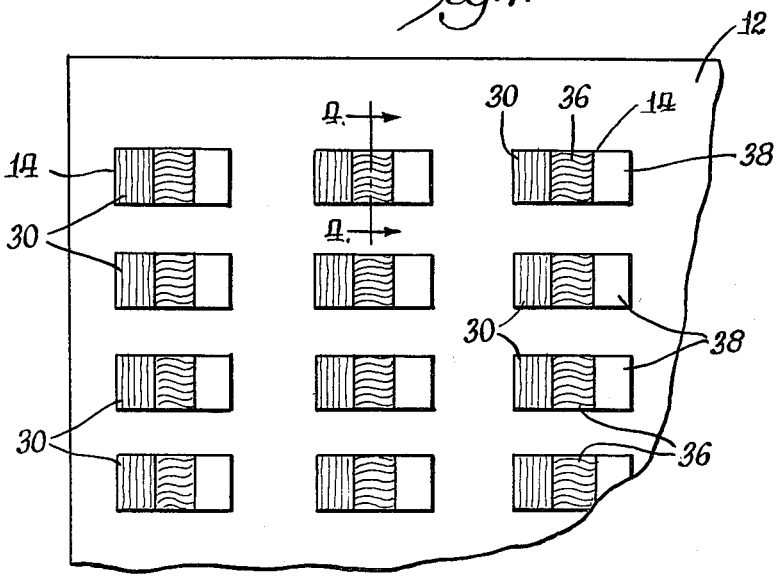
FIG. 7 is a plan view of a color display sheet with color display chips showing three finishes of a paint coating with the display chips being adhesively affixed on the sheet in rows.

As shown in FIGS. 6 and 7, preferably the film base is printed with lacquer in adjacent strips, usually about 1 inch wide, with lacquer to illustrate each finish shown on the card.

After application of the lacquers having varying clarities, the color paint coating is applied to the polymeric base on the side opposite the lacquer coated side of the polymeric base. The paint is applied by a knife over roll coating operation, as is known. In the practice of the invention it is important to recognize that the lacquer may not be coated over the paint coating to vary the appearance of the paint finish. If lacquer is applied over the paint coating a relatively rough finish results which is undesirable for the display of the coating and for the purpose of the invention. After the paint coating is applied, it is preferable in any aspect of this invention and especially with polypropylene that a thin sheet of tissue paper is laminated to the paint coating with an adhesive. The paper gives the paint coated film body and avoids curling at the edges of chips or swatches when they are applied to a mount base. For best results the backing paper should be 10 to 28 pounds bond paper on the basis of the paper being 17 inches by 22 inches, 500 count. With the paint coated film having body, one can lay or print a smaller area of adhesive onto the mount base relative to the area of the chip chip to be affixed thereon. Such printing of adhesive eliminates adhesive from creeping from under the chip causing undesired bonding and an unattractive product. Further with the tissue paper enhancing the body of the film, the color chips will not curl or rumple at the edges. In the aspect of the invention for the direct display of paint coatings the paper may be laminated to the film surface not coated with the paint. In connection with the aspect of the invention of displaying the paint coating through the film, however, after the paper is laminated to the paint coated film, the polymeric sheets are cut to the desired chip width. Preferably the sheets are cut such that one chip has various paint coating finishes in adjacent relation as shown in FIG. 7. After cutting the chips or swatches are mounted onto a mount base, preferably on high speed mounting equipment as is known and described in U.S. Pat. No. 4,061,521.

In another aspect of the invention the polymeric film base is sufficiently thin to permit the colors, tones and finishes of paints so illustrated by chips in overlapping, adjacent and stacked relation as shown in FIG. 8. In this aspect of the invention, a color which may be primarily considered by a viewer is on a large rectangular chip 42. Secondary colors which may be complimentary to the primary color also may be simultaneously illustrated and viewed on smaller chips 44 and 46 which overlap and are in adjacent relation to the large chip 42. For an aesthetically pleasing display, the smaller chips preferably are disposed at opposite corners of the larger chip 48 and 50, the smaller chips also varying in shape such as a square and rectangle. The important aspect of the invention is that the polymeric base of the chips has a thickness in the range of from about ½ to about 7 mils. This is sufficiently thin to permit the chips to be in overlapping stacked relation without increasing the thickness of the combined stacked overlapping chips to render it asethetically unsuitable for the pleasing display of colors. In this aspect of the invention, as with the other aspects of the invention, the polymeric film preferably should have a thin tissue paper backing laminated thereon and adhesive preferably is applied to the surface upon which the chip will be mounted with cutting and mounting being done as known with the equipment and methods described herein. Preferably after cutting, the various swatches or chips are mounted onto a mount base as known and described in U.S. Pat. No. 4,061,521. In this connection for high speed production, it is preferable to apply adhesive to a base sheet, mount the chips thereon, convey the sheet to another adhesive application point to lay adhesive on the base sheet and previously mounted chips with this process being continued until all of the overlapping chips are adhesively mounted.

In another embodiment of the invention, a part of the color chip or swatch is adhesively affixed to a mount base and is weakened at a tear line for easy removal of the chip from the mount base. The tear line may be made by partially cutting through the film base, slitting, perforation or the like. In the preferred embodiment the chip is made with the polymeric base with a paint coating applied thereto. The paint coated polymeric sheet is perforated to facilitate the severance of the chip into at least two parts and its removal from the mount base. A portion of the polymeric base of the chip with perforations therein is affixed to a mount base with adhesive between the mount base and at least one of the areas created by the perforation. Preferably the adhesive is applied to the mount base with polymeric chip then being applied to the adhesive and mount base to adhesively affix the chip to such base. In one preferred embodiment as shown in FIG. 9*a*, the chip is divided by a tear line 56 into two sections 58 and 60 which are approximately equal in area. Adhesive is applied between one area, such as section 58 of the chip, and the mount base to adhesively affix the chip to the mount base.

In another aspect of the embodiment of the removable chip, as shown in FIG. 9*b*, the chip is divided into three sections 64, 66 and 68 by two tear lines 70 and 72. In this embodiment, the two end sections 64 and 68 accommodate adhesive between them and the mount base. This affixes the chip to the mount base with each side of the chip adhesively affixed to the mount base, the chip being held flush to the surface of the mount base. The center section 66 of the chip may be removed from the card by grasping the center section and tearing the chip along the tear lines 70 and 72.

In the removable chip aspect of the invention after the polymeric film base is coated with paint and optionally printed with lacquer, if various glosses or sheens are to be illustrated as aforesaid, the polymeric film base may be perforated for the production of the removable color chip. Perforation may be done by a rotary knife, steel rule die or punch press as is known. In one perforation process the coated film base runs through an assembly containing a smooth cylinder below the film and perforating knives above the film. The perforating knives press through the film to the bottom cylinder. After perforation the film base passes through slitting knives which has a male portion above the film and a female portion below the film to slit the film to size for later mounting to a mount base.

The finished color display product may be a single chip with a tear line mounted onto a mount base. Alternatively the color display product may include a plurality of chips with tear lines mounted onto a mount base. In either case, a chip or chips are easily and readily removable from the mount base for display of the paint coating on the chip remote from the mount base and other color chips thereon. Further display of the paint coating still is permitted from the mount card because a portion as at 58 or portions, as at 64 and 68, of the chip remains on the mount card even after removal of the portion of the chip which is not adhesively affixed to the mount card. This permits further reference to the card for view of the paint coating and the name thereof on the mount card after the removal of the removable portion of the chip. Removal of a chip from the card permits display of the chip from a surface other than the card to permit the viewer to determine the compatibility of the paint coating on the chip in reference to surroundings other than the mount base and other color chips.

Important to all aspects of the invention is the use of translucent polymeric film. Important to the use of polypropylene as a translucent film is that it is coated with an acrylic based terpolymer coating composition resin containing wax and silica at least on the side of the film having the paint coating. The acrylic coating is needed for the paint coating to adhere to the polypropylene. The acrylic coating is not necessary for polypropylene to adhere and accomodate the lacquer and adhesive coatings. The terpolymer coating is described in U.S. Pat. Nos. 3,753,769 and 4,058,645 to Steiner and assigned to Mobil Oil Corporation. These patents are incorporated by reference as if fully rewritten herein. The acrylic coating consists of interpolymer as the film forming agent of (a) from about 2.5 to about 6 parts by weight of an alpha-beta monoethylenically unsaturated carboxylic acid such as acrylic acid, methacrylic acid, and mixtures thereof, and (b) from about 97 to about 94 parts by weight of neutral monomer esters. The neutral monomer esters include (1) methyl acrylate or ethyl acrylate and (2) methyl methacrylate. The interpolymer comprises from about 30 percent to about 55 percent by weight of methyl methacrylate when the aklyl acrylate is methyl acrylate. When the alkyl acrylate is ethyl acrylate the interpolymer comprises from about 52.5 percent to about 69 percent by weight of methyl methacrylate. The interpolymer coating also contains (1) from about 30 percent to about 60 percent by weight based upon the total weight of said interpolymer of a hot slip agent which is a finely divided, water insoluble, inorganic solid such as silica, diatomaceous earth, calcium silicate, bentonite, and finely-divided clays. The inorganic solid has a particle size between about 10 and about 200 millimicrons. The interpolymer coating further contains finely divided wax which acts as a cold slip and antiblocking material.

The coating may additionally contain adduct of rosin and an alpha-beta unsaturated dicarboxylic acid and the partial esters of the adduct and polyhydric alcohol in an amount of from about 3 to about 15 percent by weight of the acrylic polymer component.

The rosin used is wood or gum rosin, but refined or modified products may be used such as abietic acid, isomerized rosin or polymerized rosin. The rosin also may be diluted with a saturated linear dicarboxylic acid such as succinic, gluatanic, adipic, pimelic, suberic, azelaic, sebaicic and the like.

The alpha-beta unsaturated acid which may be used to form the adduct with rosin includes fumaric acid, maleic acid, maleic anhydride, itaconic acid, citraconic acid and the like.

The rosin adduct, with or without saturated dicarboxylic acids is partially esterified with a dihydric or trihydric alcohol such as ethylene glycol, propylene glycol, butylene glycol, diethylene glycol, triethylene glycol, glycerol and the like. The resultant rosin adduct should have an acid number of at least about 35 so that it can be dissolved in aqueous alkaline solution.

An oriented transparent polypropylene film both surfaces of which are coated as described herein and in U.S. Pat. Nos. 3,753,769 and 4,058,645 is commercially available as Bicor 220AB from the Mobil Chemical Company.

It should be understood that while certain preferred embodiments of the present invention have been illustrated and described, various modifications thereof will become apparent to those skilled in the art, and accordingly, the scope of the present invention should be defined only by the appended claims and equivalents thereof.

Various features of the invention are set forth in the following claims.

What is claimed is:

1. A color display product consisting essentially of a polypropylene film base with a thickness in the range of from about 2 mils to about 7 mils, said polypropylene film base having at least one surface coated with an interpolymer coating composition comprising an interpolymer as the film forming agent of (a) from about 2.5 to about 6 parts by weight of an alpha-beta monoethylenically unsaturated carboxylic acid selected from the group consisting of acrylic acid, methacrylic acid, and mixtures thereof, and (b) from about 97.5 to about 94 parts by weight of neutral monomer esters, said neutral monomer esters comprising (1) methyl acrylate or ethyl acrylate and (2) methyl methacrylate, said interpolymer comprising from about 30 percent to about 55 percent by weight of methyl methacrylate when said alkyl acrylate is methyl acrylate, and from bout 52.5 percent to about 69 percent by weight of methyl methacrylate when said alkyl acrylate is ethyl acrylate, said interpolymer coating being further characterized as containing (1) from about 30 percent to about 60 percent by weight based upon the total weight of said interpolymer, of a hot slip agent consisting of a finely divided, water insoluble, inorganic solid selected from the group consisting of silica, diatomaceous earth, calcium silicate, bentonite and finely divided clays, said inorganic solid having a particle size between about 10 and about 200 millimicrons, and (2) said interpolymer coating being further characterized by containing a cold-slip, anti-blocking material comprising finely-divided wax;

a paint coating on the surface of said film base coated with said interpolymer coating composition;

an adhesive coating; and a mount base, said film base being adhesively affixed to said mount base with said adhesive coating being on said painted coating or on said unpainted surface of said film base.

2. A color display product as recited in claim 1 wherein said interpolymer coating composition further comprises from about 3 to about 15 percent by weight based upon the interpolymer coating component of a compound selected from the group consisting of an adduct of rosin and alpha-beta unsaturated dicarboxylic acid and the partial esters of said adduct and polyhydric alcohol.

3. A color display product as recited in claim 2 wherein said mount base has a plurality of swatches adhesively affixed thereto, said swatches comprising said painted film base.

4. A color display product as recited in claim 1 wherein about 10 to about 28 pound tissue paper basis 17 inches by 22 inches 500 count is laminated on the paint coating on the film base or on the unpainted surface of the film base.

5. A color display product as recited in claim 4 wherein said mount base has a plurality of swatches adhesively affixed thereto, said swatches comprising said painted film base.

6. A color display product as recited in claim 1 wherein said mount base has a plurality of swatches adhesively affixed thereto, said swatches comprising said painted film base.

7. A method for making a color sample display device comprising:

providing a sheet of polypropylene having a thickness in the range of from about 2 mils to about 7 mils;

said polypropylene sheet having at least one surface coated with an interpolymer coating composition comprising an interpolymer as the film forming agent of (a) from about 2.5 to about 6 parts by weight of an alpha-beta monoethylenically unsaturated carboxylic acid selected from the group consisting of acrylic acid, methacrylic acid, and mixtures thereof, and (b) from about 97.5 to about 94 parts by weight of neutral monomer esters, said neutral monomer esters comprising (1) methyl acrylate or ethyl acrylate and (2) methyl methacrylate, said interpolymer comprising from about 30 percent to about 55 percent by weight of methyl methacrylate when said alkyl acrylate is methyl acrylate, and from about 52.5 percent to about 69 percent by weight of methyl methacrylate when said alkyl acrylate is ethyl acrylate, said interpolymer coating being further characterized as containing (1) from about 30 percent to about 60 percent by weight based upon the total weight of said interpolymer, of a hot slip agent consisting of a finely-divided, water insoluble, inorganic solid selected from the group consisting of silica, diatomaceous earth, calcium silicate, bentonite and finely-divided clays, said inorganic solid having a particle size between about 10 and about 200 millimicrons, and (2) said interpolymer coating being further characterized by containing a cold-slip, anti-blocking material comprising finely-divided wax;

coating the surface of said sheet coated with said interpolymer coating composition with a paint coating; and adhesively affixing said sheet to a mount base.

8. A method as recited in claim 7 wherein said interpolymer coating composition further comprises from about 3 to about 15 percent by weight based upon the interpolymer coating component of a compound selected from the group consisting of an adduct of rosin and alphabeta unsaturated dicarboxylic acid and the partial esters of said adduct and polyhydric alcohol.

9. A method as recited in claim 7 wherein said method further comprises laminating about 10 to about 28 pound tissue paper, basis 17 inches by 22 inches 500 count, to one side of said paint coated sheet.

10. A method as recited in claim 7 wherein said method further comprises cutting said sheet into a plurality of swatches which are adhesively affixed to the mount base.

11. A method for making a color sample display device for the display of at least two finishes of a paint coating, the method comprising:

providing a polymeric film base having a thickness in the range of from about 2 mils to about 7 mils, said polymeric base selected from the group consisting of polyethylene terephthalate and polypropylene, said polypropylene film base having at least one surface coated with an interpolymer coating composition comprising an interpolymer as the film forming agent of (a) from about 2.5 to about 6 parts by weight of an alpha-beta monoethylenically unsaturated carboxylic acid selected from the group consisting of acrylic acid, methacrylic acid, and mixtures thereof, and (b) from about 97.5 to about 94 parts by weight of neutral monomer esters, said neutral monomer esters comprising (1) methyl acrylate or ethyl acrylate and (2) methyl methacrylate, said interpolymer comprising from about 30 percent to about 55 percent by weight of methyl methacrylate when said alkyl acrylate is methyl acrylate, and from about 52.5 percent to about 69 percent by weight of methyl methacrylate when said alkyl acrylate is ethyl acrylate, said interpolymer coating being further characterized as containing (1) from about 30 percent to about 60 percent by weight based upon the total weight of said interpolymer, of a hot slip agent consisting of a finely-divided, water insoluble, inorganic solid selected from the group consisting of silica, diatomaceous earth, calcium silicate, bentonite and finely-divided clays, said inorganic solid having a particle size between about 10 and about 200 millimicrons, and (2) said interpolymer coating being further characterized by containing a cold-slip, anti-blocking material comprising finely-divided wax;

coating one surface of said polymeric film base with lacquer;

coating the surface of said polymeric film base which is opposite to said lacquer coated surface with a paint coating; said paint coating being on said surface of said polypropylene film base coated with said interpolymer coating composition; and adhesively affixing said film base to a mount base with an adhesive between said mount base and said paint coating, said lacquer coating controlling the appearance of the finish of the paint coating after said film base is affixed to said mount base.

12. A method as recited in claim 11 wherein said interpolymer coating composition further comprises from about 3 to about 15 percent by weight based upon the interpolymer coating component of a compound selected from the group consisting of an adduct of rosin and alpha-beta unsaturated dicarboxylic acid and the partial esters of said adduct and polyhydric alcohol.

13. A method as recited in claim 11 wherein said method further comprises laminating about 10 to about 28 pound tissue paper, basis 17 inches by 22 inches 500 count, on the painted coating of said polymeric film base.

14. A method as recited in claim 11 wherein said polymeric film base is polyethylene terephthalate.

15. A method as recited in claim 11 wherein said method further comprises cutting said polymeric film base into a plurality of swatches which are adhesively affixed to the mount base.

16. A color sample display device illustrating at least two finishes of a paint coating, the device comprising:

a polyethylene terephthalate film base having a thickness in the range of from about 2 mils to about 7 mils;

a lacquer coating on one surface of said polymeric film base;

a paint coating on the surface of said polymeric film base which is opposite to said lacquer coated surface;

an adhesive coating; and a mount base, said film base being adhesively affixed to said mount base with said adhesive coating being on said painted coating, said lacquer coated film providing at least two finishes for the display of said paint coating on said color display device.

17. A color sample display device as recited in claim 16 wherein said mount base has a plurality of swatches adhesively affixed thereto, said swatches comprising said film base with said paint and lacquer coatings.

18. A color sample display device illustrating at least two finishes of a paint coating, the device comprising:

a polymeric film base having a thickness in the range of from about 2 mils to about 7 mils, said polymeric base selected from the group consisting of polyethylene terephthalate and polypropylene, said polypropylene film base having at least one surface coated with an interpolymer coating composition comprising an interpolymer as the film forming agent of (a) from about 2.5 to about 6 parts by weight of an alpha-beta monoethylenically unsaturated carboxylic acid selected from the group consisting of acrylic acid, methacrylic acid, and mixtures thereof, and (b) from about 97.5 to about 94 parts by weight of neutral monomer esters, said neutral monomer ester comprising (1) methyl acrylate or ethyl acrylate and (2) methyl methacrylate, said interpolymer comprising from about 30 percent to about 55 percent by weight of methyl methacrylate when said alkyl acrylate is methyl acrylate, and from about 52.5 percent to about 69 percent by weight of methyl methacrylate when said alkyl acrylate is ethyl acrylate, said interpolymer coating being further characterized as containing (1) from about 30 percent to about 60 percent by weight based upon the total weight of said interpolymer, of a hot slip agent consisting of a finely-divided, water insoluble, inorganic solid selected from the group consisting of silica, diatomaceous earth, calcium silicate, bentonite and finely-divided clays, said inorganic solid having a particle size between about 10 and about 200 millimicrons, and (2) said interpolymer coating being further characterized by containing a cold-slip, anti-blocking material comprising finely-divided wax;

a lacquer coating on one surface of said polymeric film base;

a paint coating on the surface of said polymeric film base which is opposite to said lacquer coated surface, said paint coating being on said surface of said polypropylene film base coated with said interpolymer coating composition;

an adhesive coating; and a mount base, said film base being adhesively affixed to said mount base with said adhesive coating being on said painted coating, said lacquer coated film providing at least two finishes for the display of said paint coating on said color display device.

19. A color sample display device as recited in claim 18 wherein said interpolymer coating composition further comprises from about 3 to about 15 percent by weight based upon the interpolymer coating component of a compound selected from the group consisting of an adduct of rosin and alpha-beta unsaturated dicarboxylic acid and the partial esters of said adduct and polyhydric alcohol.

20. A color sample display device as recited in claim 19 wherein said mount base has a plurality of swatches adhesively affixed thereto, said swatches comprising said film base with said paint and lacquer coatings.

21. A color sample display device as recited in claim 18 wherein about 10 to about 28 pound tissue paper, basis 17 inches by 22 inches 500 count, is laminated on the painted coating of said polymeric film base.

22. A color sample display device as recited in claim 18 wherein said mount base has a plurality of swatches adhesively affixed thereto, said swatches comprising said film base with said paint and lacquer coatings.

23. A color sample display device for the display of at least two paint coatings, the device comprising:

a mount base;

a first adhesive coating;

a first polymeric film base having a thickness in the range of from about 2 mils to about 7 mils, said polymeric base selected from the group consisting of polyethylene terephthalate and polypropylene, said polypropylene film base having at least one surface coated with an interpolymer coating composition comprising an interpolymer as the film forming agent of (a) from about 2.5 to about 6 parts by weight of an alpha-beta monoethylenically unsaturated carboxylic acid selected from the group consisting of acrylic acid, methacrylic acid, and mixtures thereof, and (b) from about 97.5 to about 94 parts by weight of neutral monomer esters, said neutral monomer esters comprising (1) methyl acrylate or ethyl acrylate and (2) methyl methacrylate, said interpolymer comprising from about 30 percent to about 55 percent by weight of methyl methacrylate when said alkyl acrylate is methyl acrylate, and from about 52.5 percent to about 69 percent by weight of methyl methacrylate when said alkyl acrylate is ethyl acrylate, said interpolymer coating being further characterized as containing (1) from about 30 percent to about 60 percent by weight based upon the total weight of said interpolymer, of a hot slip agent consisting of a finely-divided, water insoluble, inorganic solid selected from the group consisting of silica, diatomaceous earth, calcium silicate, bentonite and finely-divided clays, said inorganic solid having a particle size between about 10 and about 200 millimicrons, and (2) said interpolymer coating being further characterized by containing a cold-slip, anti-blocking material comprising finely-divided wax;

a second adhesive coating;

a second polymeric film base having a thickness in the range of from about 2 mils to about 7 mils, said second polymeric base selected from the group consisting of polyethylene terephthalate and polypropylene, said polypropylene film of said second polymeric base having at least one surface coated with said interpolymer coating composition; and paint coatings on the surfaces of said first and second film bases, said paint coatings on the surfaces of said polypropylene film bases having said interpolymer coatings, said first adhesive coating adhesively affixing said first film base to said mount base, said second adhesive coating adhesively affixing said second film base to said first film base and said mount base in stacked overlapping relation for the display of at least two paint coatings in adjacent relation.

24. A color sample display device as recited in claim 23 wherein said interpolymer coating composition further comprises from about 3 to about 15 percent by weight based upon the interpolymer coating component of a compound selected from the group consisting of an adduct of rosin and alpha-beta unsaturated dicarboxylic acid and the partial esters of said adduct and polyhydric alcohol.

25. A color sample display device as recited in claim 23 wherein about 10 to about 28 pound tissue paper, basis 17 inches by 22 inches 500 count, is laminated to one side of said first paint coated film base and to one side of said second painted coated film base.

26. A color sample display device as recited in claim 23 wherein said mount base has a plurality of swatches adhesively affixed thereto, said swatches comprising said first and second film bases.

27. A color sample display device for the display of at least two paint coatings, the device comprising:

a mount base;

a first adhesive coating;

a first polyethylene terephthalate film base having a thickness in the range of from about 2 mils to about 7 mils;

a second adhesive coating;

a second polyethylene terephthalate film base having a thickness in the range of from about 2 mils to about 7 mils; and paint coatings on the surfaces of said first and second film bases, said first adhesive coating adhesively affixing said first film base to said mount base, said second adhesive coating adhesively affixing said second film base to said first film base and said mount base in stacked overlapping relation for the display of at least two paint coatings in adjacent relation.

28. A color sample display device as recited in claim 27 wherein said mount base has a plurality of swatches adhesively affixed thereto, said swatches comprising said first and second film bases.

29. A color sample display device for the display of a paint coating remote from the display device, said display device comprising:

a mount base;

an adhesive coating, a polymeric film base adhesively affixed to said mount base, said polymeric film base having a thickness of from about 2 mil to about 7 mils, said polymeric base selected from the group consisting of polyethylene terephthalate and polypropylene, said polypropylene film base having at least one surface coated with an interpolymer coating composition comprising an interpolymer as the film forming agent of (a) from about 2.5 to about 6 parts by weight of an alpha-beta monoethylenically unsaturated carboxylic acid selected from the group consisting of acrylic acid, methacrylic acid, and mixtures thereof, and (b) from about 97.5 to about 94 parts by weight of neutral monomer esters, said neutral monomer esters comprising (1) methyl acrylate or ethyl acrylate and (2) methyl methacrylate, said interpolymer comprising from about 30 percent to about 55 percent by weight of methyl methacrylate when said alkyl acrylate is methyl acrylate, and from about 52.5 percent to about 69 percent by weight of methyl methacrylate when said alkyl acrylate is ethyl acrylate, said interpolymer coating being further characterized as containing (1) from about 30 percent to about 60 percent by weight based upon the total weight of said interpolymer, of a hot slip agent consisting of a finely-divided, water insoluble, inorganic solid selected from the group consisting of silica, diatomaceous earth, calcium silicate, bentonite and finely-divided clays, said inorganic solid having a particle size between about 10 and about 200 millimicrons, and (2) said interpolymer coating being further characterized by containing a cold-slip, anti-blocking material comprising finely-divided wax; and a paint coating on said film base, said paint coating on said surface of said polypropylene film base which is coated with said interpolymer coating composition, said film base having a tear line to facilitate removal of a portion of said film base from said mount and for display of said paint coating remote from said color sample display device.

30. A color sample display device as recited in claim 29 wherein said interpolymer coating composition further comprises from about 3 to about 15 percent by weight based upon the interpolymer coating component of a compound selected from the group consisting of an adduct of rosin and alpha-beta unsaturated dicarboxylic acid and the partial esters of said adduct and polyhydric alcohol.

31. A color sample display device as recited in claim 29 wherein said mount base has a plurality of swatches adhesively affixed thereto, said swatches comprising said film base having said tear line.

32. A color sample display device as recited in claim 29 wherein said mount base has a plurality of swatches adhesively affixed thereto, said swatches comprising said film base having said tear line.

33. A color sample display device as recited in claim 29 wherein about 10 to about 28 pound tissue paper, basis 17 inches by 22 inches 500 count, is laminated to one side of said paint coated film base.

34. A color sample display device for the display of a paint coating remote from the display device, said display device comprising:

a mount base;

an adhesive coating;

polyethylene terephthalate film base adhesively affixed to said mount base; and a paint coating on said film base, said polymeric film base having a tear line to facilitate removal of a portion of said film base from said mount and for display of said paint coating remote from said color sample display device.

35. A color sample display device as recited in claim 34 wherein said mount base has a plurality of swatches adhesively affixed thereto, said swatches comprising said film base having said tear line.

36. A color display device for illustrating one or more finishes of a paint coating the device comprising a polymeric film base having a thickness in the range of from about 2 mils to about 7 mils, said polymeric base selected from the group consisting of polyethylene terephthalate and polypropylene, said polypropylene film base having at least one surface coated with an interpolymer coating composition comprising an interpolymer as the film forming agent of (a) from about 2.5 to about 6 parts by weight of an alpha-beta monoethylenically unsaturated carboxylic acid selected from the group consisting of acrylic acid, methacrylic acid, and mixtures thereof, and (b) from about 97.5 to about 94 parts by weight of neutral monomer esters, said neutral monomer esters comprising (1) methyl acrylate or ethyl acrylate and (2) methyl methacrylate, said interpolymer comprising from about 30 percent to about 55 percent by weight of methyl methacrylate when said alkyl acrylate is methyl acrylate, and from about 52.5 percent to about 69 percent by weight of methyl methacrylate when said alkyl acrylate is ethyl acrylate, said interpolymer coating being further characterized as containing (1) from about 30 percent to about 60 percent by weight based upon the total weight of said interpolymer, of a hot slip agent consisting of a finely-divided, water insoluble, inorganic solid selected from the group consisting of silica, diatomaceous earth, calcium silicate, bentonite and finely-divided clays, said inorganic solid having a particle size between about 10 and about 200 millimicrons, and (2) said interpolymer coating being further characterized by containing a cold-slip, anti-blocking material comprising finely-divided wax;

a lacquer coating on one surface of said polymeric film base;

a paint coating on the surface of said polymeric film base which is opposite to said lacquer coated surface, said paint coating being on said surface of said polypropylene film based coated with said interpolymer coating composition;

an adhesive coating; and a mount base, said film base being adhesively affixed to said mount base with said adhesive coating being on said painted coating, said lacquer coated film providing the finish for the display of said paint coating on said color display device.

37. A color sample display device as recited in claim 36 wherein said interpolymer coating composition further comprises from about 3 to about 15 percent by weight based upon the interpolymer coating component of a compound selected from the group consisting of an adduct of rosin and alpha-beta unsaturated dicarboxylic acid and the partial esters of said adduct and polyhydric alcohol.

38. A color sample display device as recited in claim 36 wherein about 10 to about 28 pound tissue paper, basis 17 inches by 22 inches 500 count, is laminated on the painted coating of said polymeric film base.

39. A color sample display device as recited in claim 38 wherein said mount base has a plurality of swatches adhesively affixed thereto, said swatches comprising said film base with said paint and lacquer coatings.

40. A color sample display device as recited in claim 36 wherein said mount base has a plurality of swatches adhesively affixed thereto, said swatches comprising said film base with said paint and lacquer coatings.

* * * * *